United States Patent [19]

Ando et al.

[11] 4,052,969

[45] Oct. 11, 1977

[54] EXHAUST GAS RECIRCULATION VALVE DEVICE FOR AN INTERNAL COMBUSTION ENGINE

[75] Inventors: Masahisa Ando, Aichi; Keigo Katow, Toyota; Masami Yamazaki, Toyokawa, all of Japan

[73] Assignee: Toyota Jidosha Kogyo Kabushiki Kaisha, Japan

[21] Appl. No.: 694,392

[22] Filed: June 9, 1976

[30] Foreign Application Priority Data

Feb. 24, 1976 Japan ..... 51-18418

[51] Int. Cl.[2] ..... F02M 25/06

[52] U.S. Cl. ..... 123/119 A; 251/61.4; 251/61.5

[58] Field of Search ..... 123/119 A; 251/61.2, 251/61.3, 61.4, 61.5; 92/100, 97, 46

[56] References Cited

U.S. PATENT DOCUMENTS

| | | | |
|---|---|---|---|
| 2,588,656 | 3/1952 | Paget | 251/61.5 |
| 3,322,142 | 5/1967 | Baumann | 251/61.4 |
| 3,800,765 | 4/1974 | Thompson | 123/119 A |
| 3,885,538 | 5/1975 | Suter | 123/119 A |
| 3,888,222 | 6/1975 | Tomita | 123/119 A |
| 3,902,696 | 9/1975 | Itu et al. | 251/61.5 |
| 3,924,589 | 12/1975 | Nohira et al. | 123/119 A |

FOREIGN PATENT DOCUMENTS

| | | | |
|---|---|---|---|
| 2,166,337 | 6/1971 | Germany | 123/119 A |
| 2,311,426 | 3/1973 | Germany | 251/61.5 |

*Primary Examiner*—Wendell E. Burns
*Attorney, Agent, or Firm*—Stevens, Davis, Miller & Mosher

[57] ABSTRACT

An exhaust gas recirculation valve device for an exhaust gas cleaning apparatus of an internal combustion engine for an automobile, which device comprises a diaphragm mechanism mounted on a body for operating the valve device. The diaphragm mechanism has a diaphragm and has, on both sides of the diaphragm, chambers which should be connected to the respective engine ports. One of the chambers, on the side of the diaphragm facing the surface of the body, is formed by a bellows member, made of rubber material, which is held apart from the surface of the body so that the bellows is effectively insulated from the high temperature of the body caused by the high temperature exhaust gas passing through the body.

1 Claim, 8 Drawing Figures

EXHAUST GAS RECIRCULATION VALVE DEVICE FOR AN INTERNAL COMBUSTION ENGINE

FIELD OF THE INVENTION

The present invention relates to an exhaust gas recirculation valve device for an internal combustion engine for an automobile.

BACKGROUND OF THE INVENTION

In an automobile exhaust gas cleaning system, of the exhaust gas recirculation type, an exhaust gas recirculation valve (EGR valve) is used. The EGR valve recirculates a part of the exhaust gas from the exhaust system to the intake system in accordance with negative pressure in the carbureter.

An EGR valve is known which comprises a body which forms a passage connected to the exhaust line and another passage connected to the intake line, a valve member between said passages, and a diaphragm mechanism mounted on the body and having a diaphragm connected to the valve member through a rod so as to open or close the valve member in response to vacuum in the carbureter. In this known EGR valve, the diaphragm mechanism is of one of two types. One is a "single chamber type", which has a chamber formed on one side of the diaphragm apart from the body, and the other is a "double chamber type" which has a chamber formed on each side of the diaphragm.

In the known double chamber type, which is used when complicated EGR operation is desired, the second chamber, formed on the side of the diaphragm facing the body, is formed so as to contact the surface of the body. In this case, to prevent leakage of the exhaust gas into the second chamber through a gap between the body and the rod which is in a slidable relationship with the body, a bellows member is used which is made of teflon material and is disposed between the rod and the body. The reason the teflon material is used is that temperature of the body through which the exhaust gas is recirculated becomes very high during the recirculation operation.

It should be noted that the teflon bellows can be used without thermal degradation when the temperature thereof does not exceed 270° C. However, the temperature of the body is easily raised so as to exceed 270° C, because the temperature of the exhaust gas is very high. Therefore, in the known EGR apparatus the EGR valve is used together with a cooling device for the exhaust gas (a so called EGR cooler) so as to prevent the bellows member from being thermaly degraded. Another drawback of the known EGR valve is that the manufacturing cost is relatively high because the teflon material is expensive.

SUMMARY OF THE INVENTION

One object of the present invention is to provide an EGR valve in which it is possible to use a bellows member made of rubber material in place of teflon material.

Another object of the present invention is to provide an EGR valve device which eliminates the need for an additional means for cooling the exhaust gas, such as an EGR cooler.

A further object of the invention is to provide an EGR valve device of low cost.

To attain these objects, according to the invention, a valve device for exhaust gas recirculation system for an internal combustion engine is provided, wherein the valve device comprises: a body which forms a first passageway adapted for connection with the exhaust line of the engine and a second passageway adapted for connection with the intake line of the engine; a valve member adapted for opening or closing a valve seat provided between the first and second passageway, and; a diaphragm mechanism having a casing fixed on a surface of said body, a diaphragm arranged cross the interior of the casing, a rod with one end connected to said valve member and the other and fixed to said diaphragm so that a first chamber adapted for connection with an engine port is formed on the side of the diaphragm remote from the valve member, and a spring member which urges said diaphragm so as to close the communication between the first and second passageways. The valve device further comprises a bellows member which forms a second chamber on the side of the diaphragm facing the body, which second chamber is adapted for the connection with another engine port, and means by which said bellows member is held apart from said surface of the body on, which said casing is fixed, whereby the bellows member is effectively insulated from the high temperature of the body.

DESCRIPTION OF THE EMBODIMENTS

Figure 1:
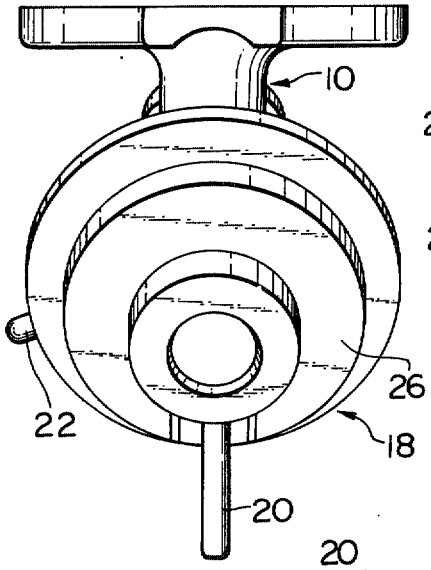
FIG. 1 is a horizontal elevational view of the EGR valve according to the invention.
Figure 2:
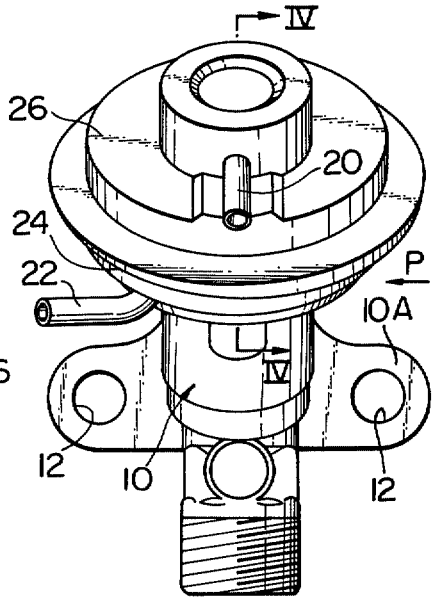
FIG. 2 is an upper elevational view of the EGR valve in FIG. 1.

Referring to FIGS. 1 through 5, showing an embodiment of an exhaust gas recirculation valve (EGR valve) according to the invention, a numeral 10 designates a body which is mounted to the engine wall (not shown), or other suitable position of the engine body, by a leg portion 10A having holes 12 through which bolts pass to secure the body 10 to the engine wall. The valve body 10 forms a passageway 14 adapted for communication with the engine exhaust manifold (not shown) and a passageway 16 adapted for communication with the engine intake manifold (not shown).

A diaphragm mechanism 18 is mounted on the valve body 10. The diaphragm mechanism 18 has two chambers 30 and 40 (FIG. 4) conneced to a respective engine port through a tube 20 and 22, respectively. The diaphragm mechanism 18 has a rod 23 provided with a valve member 21 on the end of the rod 23 away from the diaphragm mechanism 18. The valve member 21 opens or closes a valve seat 15 formed between the passageway 14 and 16, in response to a vacuum signal transmitted to the diaphragm mechanism 18 from the engine ports via the tubes 20 and 22.

Figure 4:
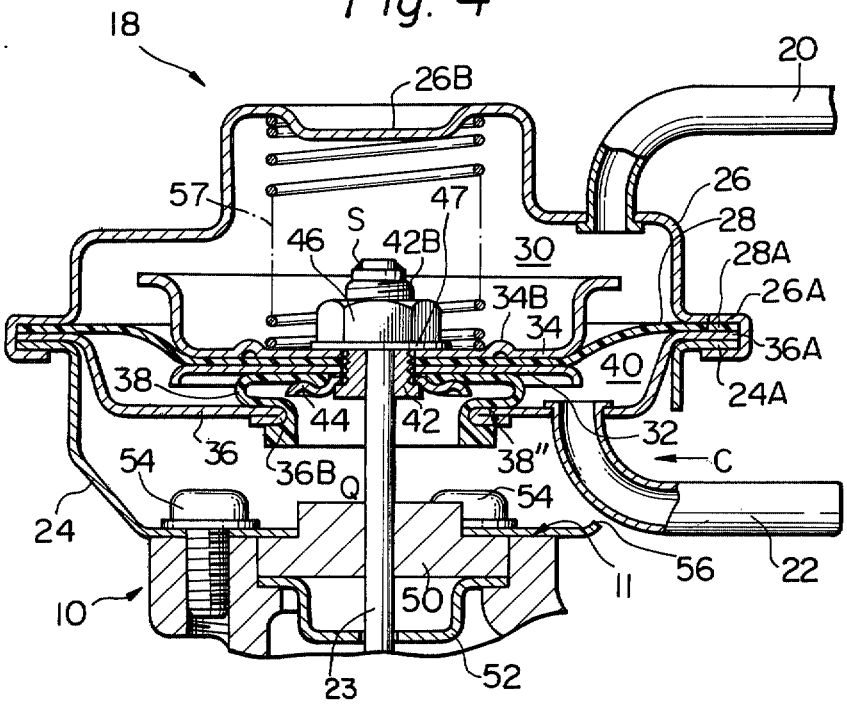
FIG. 4 is an enlarged sectional view of a diaphragm mechanism of the EGR valve in FIGS. 1, 2 and 3.

As shown in FIG. 4, the diaphragm mechanism 18 has a lower casing 24 secured to the valve body 10 and an upper casing 26 secured to the lower casing 24. A diaphragm 28 made of rubber material is arranged across the interior of the diaphragm mechanism 18 between the lower and upper casing 24 and 26 so as to form the a first chamber 30 on one side of the diaphragm 28 remote from the body 10. The diaphragm 28 is sandwiched by, a lower and upper plate 32 and 34, respectively.

According to the invention, a bellows member 38, made of rubber material, is arranged on the side of the diaphragm 28 facing the body 10. The bellows member 38 forms a sleeve shape. The lower side of the bellows member 38 is held by a plate member 36 arranged across the interior of the diaphragm member 18 between the casings 24 and 26 so as to allow the member 38 to be kept apart from a surface 11 of the valve body 10. The diameter of the bellows member 38 is smaller than the diameter of the diaphragm so that a second chamber 40 is formed between the diaphragm 28, the plate member 36 and the bellows 38.

The diaphragm 28 and the plate 36 are, at peripheral portions 28A and 36A thereof, secured to the casings 24 and 26 between flange portions 24A and 26A thereof, shown in FIG. 4.

The upper side of the bellows member 38, which is remote from the surface 11 of the body 10, is secured to the diaphragm 28, by means of a sleeve 42 having a flange portion 42A and a stem portion 42B, a ring member 44 which is inserted into the stem portion 42B and a nut 46 which is screwed into the stem portion 42B of the sleeve 42. In this case the diameter of the flange portion 42A is so determined that the flange portion 42A engages an inner opening 44C of the ring member 44 when the stem portion 42B is inserted into the opening 44C.

When manufacturing this valve, the stem portion 42B of the sleeve 42 is first inserted into an opening 38C of the bellows 38 and an opening 28C of the diaphragm 28 arranged between the lower and upper plates 34 and 32, through the ring member 44. Next, the nut 46 is screwed into the stem portion 42B through a washer 47, so that the these parts 28, 32, 34, 38 and 44 are secured to each other by the nut 46 and the flange portion 42A of the sleeve 42.

Figure 5:
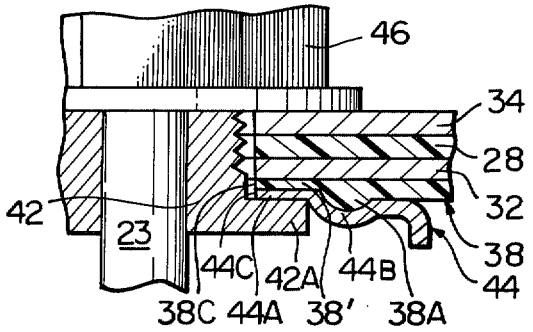
FIG. 5 is an enlarged view of a part of FIG. 4.

As shown in FIG. 5, the ring member 44 has a portion 44A which slightly projects toward the bellows member 38, the diameter of the portion 44A being larger than the diameter of the flange portion 42A of the sleeve 42. The bellows member has a portion 38' which is slightly recessed. The projected portion 44A of the ring member 44 is fitted into the recess portion 38' of the bellows 38. Further, the bellows member 38 has an annular projection 38A around the recess portion 38', which annular projection 38 is fitted to an annular recess 44B formed on the ring member 44 around the projected portion 44A. As a result, the upper side of the bellows member 38 is secured between the ring member 44 and plate 32, without causing the bellows member to be excessively deformed by a force applied by the nut 46. After the upper side of the bellows member 44 is secured to the diaphragm 28 by the sleeve 42 and the nut 46, the sleeve 42 is welded to the rod 23 at the point shown by *s*, so that the diaphragm 28 and bellows member 44 are secured to the upper end of the rod 23. The bellows member has, at the lower side thereof, an annular groove 38" formed on the outer surface of the member as shown in FIG. 4. Tightly fitted to the groove 38" is an inner circular edge portion 36B formed on the plate 36.

As shown in FIG. 4, a bottom of the lower casing 24 is secured to the upper surface 11 of the body 10 by bolts 54. A guide 50 for the rod 23 and a dust cover 52 are arranged between the lower casing 24 and the body 10. The lower casing 24 has a plurality of holes 56 between the plates 36 and the surface 11. The tube 22 is introduced into the second chamber 40 through one of the holes 56.

Figure 3:
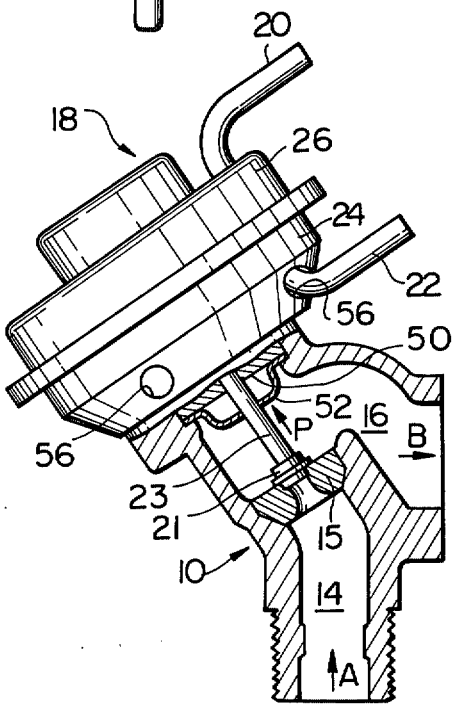
FIG. 3 is a vertical elevational view of the EGR valve in FIG. 2, partly shown in cross section.

A coil spring 57 is arranged in the first chamber 30 urging the diaphragm 28 so as to allow the valve member 21 to be displaced and close the valve seat 15 as shown in FIG. 3. A recess 26B formed on the inner wall of the upper casing 26 and an annular projection 34B formed on the upper plate 34 are seats for the spring 56.

In the use of the above mentioned EGR valve, vacuum signals from the engine ports (not shown) are transmitted to the first and second chamber 30 and 40, via the respective pipes 20 and 22. The diaphragm 28 and the bellows 30 are displaced in accordance with the pressure difference between the first and second chamber 30 and 40, so that the valve member 21 connected to the diaphragm 28 via the rod 23 is displaced in a direction shown by an arrow p. This cause a part of the exhaust gas to be recirculated from the passageway 14 in FIG. 3 as shown by an arrow A to the passageway 16 as shown by an arrow B.

During the exhaust gas recirculation operation the bellows member 38, made of rubber material, is effectively protected from the heat caused by the high temperature of the exhaust gas which flows in the passageways 14 and 16 in the body 10 as shown by the arrows A and B. This is because, the bellows member 38 is, in the present invention, spaced apart from the surface 11 of the body 10 so as to form a heat insulating space Q between the body 10 and the bellows member 38. As a result the rubber material, which is very cheap in comparison with the teflon material, used in the well known EGR valve, can be used according to the invention. The bellows 38 according to the invention is also insulated from the high temperature of body 10 by the plurality of holes 56 formed in the lower casing 24 between the bellows 38 and the surface 11 of the valve body 10. When vehicle moves, air flow is generated between the bellows 38 and the surface as shown by an arrow C through the holes 56. This air flow C allows effective insulation of the bellows 38 from the high temperature of the body 10.

Figure 6:
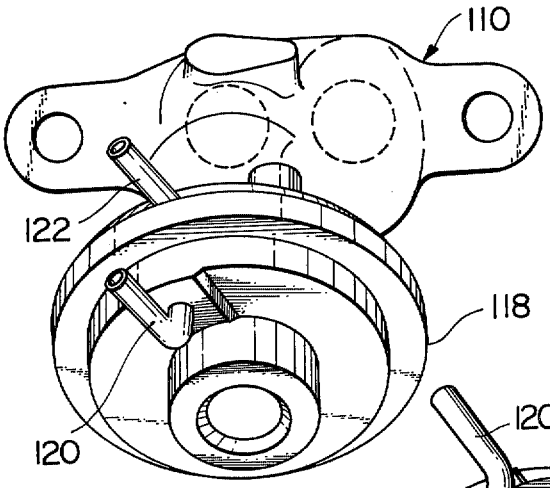
FIGS. 6, 7 and 8 are a horizontal, upper and vertical elevational view, respectively, of a second embodiment of the EGR valve according to the invention.
Figure 7:
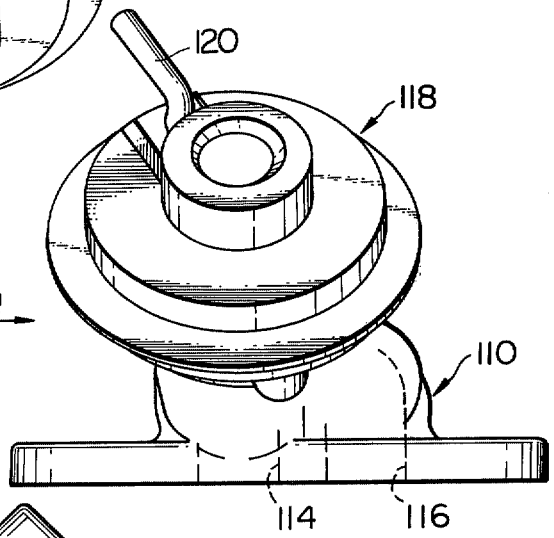
Figure 8:
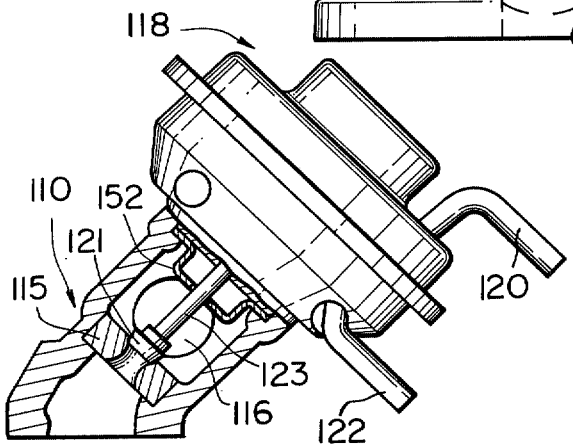

In a modification of the present invention, as shown in FIGS. 6 through 8, a body 110 is slightly reformed in comparison with the body 10 in FIGS. 1 through 5. The body 110, which should be mounted to the engine wall (not shown), has a passageway 114 connected to the intake manifold and another passageway 116 connected to the exhaust manifold. A valve member 121, adapted for opening or closing a valve seat 115 between the passageways 114 and 116, is connected, via a rod 123, to a diaphragm mechanism 118 which is similar to the diaphragm mechanism 18 in FIGS. 1 through 5. A dust plate 152 is arranged on the rod 123 in slidable relation therewith.

It will be understood the above description is merely illustrative of preferred embodiments of the invention. Additional modification can be easily anticipated by those skilled in the art from the present diclosure, and such modification may be presumed to be within the scope of the invention as defined by the claims.

What is claimed is:

1. A valve device for an exhaust gas recirculation system for an internal combustion engine, comprising:

a body forming a first passageway adapted for connection with the exhaust line of the engine and a second passageway adapted for connection with the intake of the engine;

a valve seat between the first and second passageways;

a valve member adapted for opening or closing the valve seat;

a diaphragm casing fixed on a surface of the body;

a diaphragm arranged across the interior of the casing so that a first chamber adapted for connection with an engine port is formed on one side of the diaphragm remote from said surface of the body, said diaphragm being secured to the casing at the periphery of the diaphragm;

a rod slidably supported by the body, one end of the rod being connected to the valve member;

a spring member within said first chamber of said diaphragm casing urging said diaphragm toward said body;

a set of first plates to hold the diaphragm therebetween;

a second plate having a central circular opening arranged across the interior of the casing between the diaphragm and said surface, the second plate being secured to the casing at the periphery thereof in such a manner that the second plate is parallel to and spaced from said surface;

a bellows member of sleeve shape made of rubber material disposed between the diaphragm and the second plate forming on the side of the diaphragm near the body, a second chamber adapted for connection to another engine port, the bellows member having a circular groove on a first end thereof remote from the diaphragm, the circular groove being vacuum tightly fitted to the circular opening in the second plate, so that said first end of the bellows member is fixedly secured to the second plate;

a sleeve member secured to the other end of the valve rod away from the valve member, said sleeve member having a flange portion and a stem portion having a thread thereon, which stem portion passes through an opening formed on a second end of the bellows member near the diaphragm and through an opening formed on the diaphragm sandwiched by said set of first plates;

a ring member on said stem portion having a surface engaging said flange portion, said ring member being between said flange portion of the sleeve member and one of said set of first places facing the opposite side of said surface of said ring member, said ring member having a portion which projects toward said diaphragm and which is fitted to a recess formed on said second end of the bellows member;

a nut member which is screwed onto said thread so that the second side of the bellows member made of rubber material is fixed to the diaphragm without undue deformation.

* * * * *